US005711276A

United States Patent [19]

Frank

[11] Patent Number: 5,711,276

[45] Date of Patent: Jan. 27, 1998

[54] AGGREGATE FOR FEEDING FUEL FROM SUPPLY TANK TO INTERNAL COMBUSTION ENGINE OF MOTOR VEHICLE, AND METHOD OF PRODUCING THE SAME

[76] Inventor: Kurt Frank, Schelmenwasen 14, 73614 Schorndorf, Germany

[21] Appl. No.: 748,390

[22] Filed: Nov. 13, 1996

[30] Foreign Application Priority Data

Dec. 30, 1995 [DE] Germany ..... 195 49 196.3

[51] Int. Cl.[6] ..... F02M 37/04; F01D 1/02

[52] U.S. Cl. ..... 123/495; 415/200; 415/55.1

[58] Field of Search ..... 415/55.1–55.4, 415/200, 215.1; 417/423.14; 123/495, 497, 509

[56] References Cited

U.S. PATENT DOCUMENTS 3,871,796 3/1975 Mack ..... 415/423.14

5,141,396 8/1992 Schmidt et al. ..... 415/200

5,378,125 1/1995 Frank et al. ..... 415/55.1

5,549,446 8/1996 Gaston et al. ..... 415/215.1

*Primary Examiner*—Thomas N. Moulis

*Attorney, Agent, or Firm*—Michael J. Striker

[57] ABSTRACT

An aggregate for feeding fuel from a supply tank to an internal combustion engine of a motor vehicle has a feed pump having a disk-shaped feeding member, and means for forming a pump chamber in which the feeding member rotates, the means including a first wall part and a second wall part arranged at a distance from one another in direction of a rotary axis of the feeding member, at least one of the wall parts having a ring portion formed for a radial limiting and connectable with the other of the wall parts, the first and second wall parts and the feeding member which is preliminarily increase in volume are positioned relative to one another without a gap, and thereafter the first and second wall parts are fixedly connected with one another.

12 Claims, 2 Drawing Sheets

AGGREGATE FOR FEEDING FUEL FROM SUPPLY TANK TO INTERNAL COMBUSTION ENGINE OF MOTOR VEHICLE, AND METHOD OF PRODUCING THE SAME

BACKGROUND OF THE INVENTION

The present invention relates to an aggregate for feeding fuel from a supply tank to an internal combustion engine of a motor vehicle, and to a method of producing the aggregate.

German patent document DE-U 92 10 600.5 discloses a feeding aggregate in which a required axial gap of a feeding member in a pump chamber of approximately 10 μm 25 μm is provided by insertion of a spacer located between an inner wall of the pump chamber and an end surface of a spacing plate associated with the inner wall. The thickness of the spacer is determined by the value of the prescribed axial gap. The required axial gap can be adjusted by insertion of an additional component. Therefore, it is no longer necessary to provide a highly accurate machining of wall parts of the pump chamber which face the feeding member, for obtaining the axial gap of the feeding member. Such machining is usually very time consuming and cost-intensive. In the prior art it was therefore necessary to determine the components of the pump chamber in the feeding member with respect to their thickness measurement to provide an accurate selection of the spacer so as to adjust the required axial gap.

SUMMARY OF THE INVENTION

Accordingly, it is an object of the present invention to provide an aggregate for feeding fuel from a supply tank to an internal combustion engine of a motor vehicle, which avoids the disadvantages of the prior art.

In keeping with these objects and with others which will become apparent hereinafter, one feature of the present invention, resides, briefly stated, in a feeding aggregate in which the first and second wall parts of a pump chamber and the feeding member which is increased in volume by a proceeding treatment, are arranged without a gap relative to one another, and then the first and the second wall parts are fixedly connected with one another.

In the feeding aggregate in accordance with the present invention, the required axial gap is obtained without a mechanical treatment of the components of a pump part. The components of the pump part can be assembled without expensive and precise treatment of sealing surfaces. With the use of physical and chemical material properties, the cost-intensive and time-consuming treatment of components of the pump part are dispensed with. The components of the pump part are positioned in adjoining condition without a gap, and subsequently a first and a second wall part of the pump part are connected with one another. A volume increase of the feeding member by a preliminary treatment comes back automatically after a relatively shod time, to its initial volume condition. Thereby a defined axial gap can be adjusted between the first wall part and the feeding member on the one hand, and between the second wall part and the feeding member on the other hand. The positioning of the first and second wall parts relative to one another remains preserved.

In accordance with another feature of the present invention, the feeding member is thermally treated. By a targeted heating, a volume increase of the feeding member which is preferably composed of synthetic plastic is performed. After cooling, it again assumes its initial condition. The heating can be provided by an energy source, such as for example by a radiation in a heating oven, ultrasound and the like.

In accordance with still a further feature of the present invention, the feeding member is chemically treated by a medium which causes a swelling. The feeding member which is preferably composed of synthetic plastic can be introduced in a medium for a shod time, and thereby because of at least a chemical reaction, a swelling of the feeding member can be provided. The swelling is exactly determinable in dependence on time, temperature, duration, type of the medium or other parameters. After the mounting, the medium which causes the swelling can evaporate, whereby a reduction of the swelling can be provided and the feeding member obtains its initial condition.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION Of PREFERRED EMBODIMENTS

An arrangement for feeding fuel from a supply tank 11 to an internal combustion engine 12 of a not shown motor vehicle has a feeding aggregate 14. In the shown embodiment it is connected through a suction conduit 16 with the supply tank 11 and can be arranged inside or outside of the supply tank 11.

Figure 1:
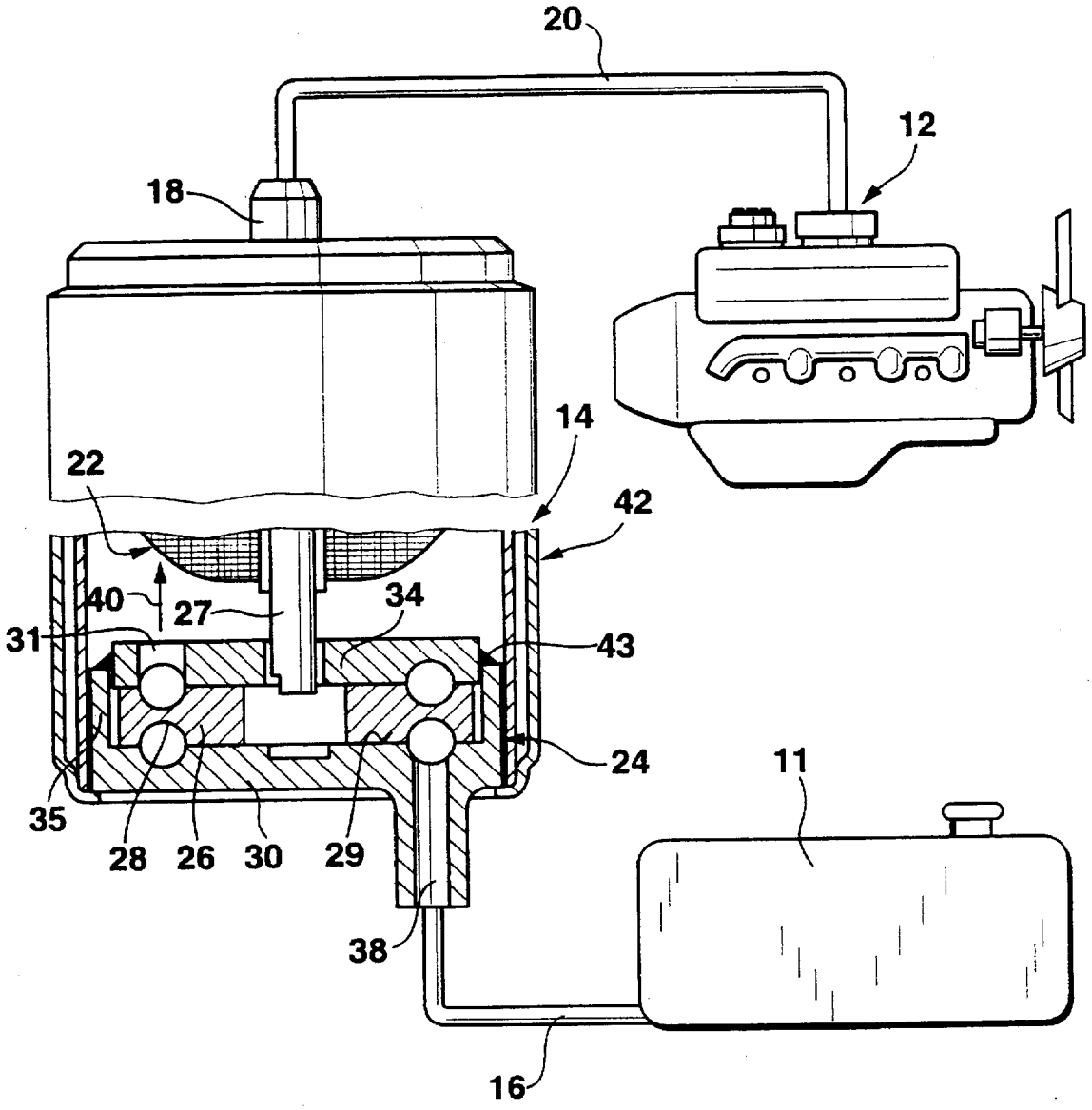
FIG. 1 is a view showing an arrangement for feeding fuel with a fuel aggregate from a supply tank to an internal combustion on a motor vehicle, not on a scale and partially sectioned.

A pressure conduit 20 is connected with a pressure pipe 18 of the feeding aggregate 14 for supplying the fuel supply aggregate 14 of the internal combustion 12 with fuel from the supply tank 11. For this purpose, the feeding aggregate 14 is provided with an electric drive motor 22 partially shown in FIG. 1. The drive motor 22 drives a feeding pump 24 which in the shown embodiment is formed as a flow pump. The feeding pump 24 has a feeding member 26 formed as an impeller and connected with an armature shaft 27 of the drive motor 22. The feeding member 26 is provided with a rim of vanes 28 arranged in its edge or peripheral region.

The impeller 26 of the feeding pump 24 rotates in a pump chamber 29. The pump chamber is limited by a first wall part 30 which is formed as a suction cover and a second wall part 34 which is formed as an intermediate housing. The first wall part 30 has a suction opening 38 connected with the suction conduit 16 for aspirating fuel into the pump chamber 29. The fuel leaves the pump chamber 29 through a pressure opening 31 and flows in direction of the arrow 40 through the housing 42 of the feeding aggregate 14 to be supplied through the pressure pipe 18 and into the pressure conduit 20. As can be seen, the fuel which flows in direction of the arrow 40 passes through the electric drive motor 22.

Figure 2:
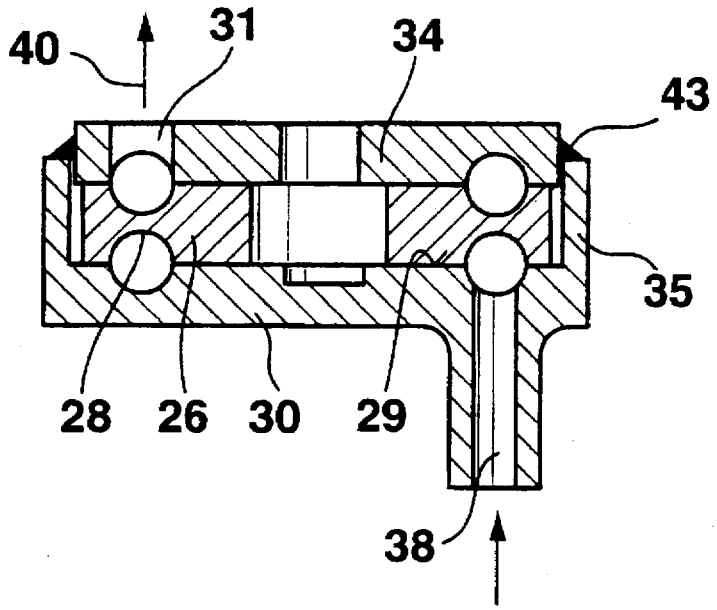
FIG. 2 is a view showing a feeding pump which is a part of the feeding aggregate, on an enlarged scale and partially sectioned, in joining condition.

An arrangement of the feeding pump 24 in joining condition is shown in detail in FIG. 2. Before positioning the feeding pump 24 shown in FIG. 2 by positioning of the first and second wall part 30, 34 and the feeding member 26 therebetween without a gap, the feeding member 26 is treated for volume increase. The feeding member 26 is preferably composed of synthetic plastic.

In accordance with the invention, a thermal treatment is utilized. By applying the action of heat to the feeding member 26 formed of synthetic plastic, a desired volume increase can be obtained in dependence on the time. In this condition the components of the pump part 30, 34, 26 are positioned relative to one another and located in ajoining condition. After cooling of the feeding member 26 a defined gap is formed. This can be obtained by the degree of volume increase which is determinable by the time of heating. Furthermore, the selection of the synthetic plastic can influence the volume increase.

In accordance with the present invention it is also possible to produce the volume increase by swelling. For this purpose the feeding member 26 is placed in a medium over a certain time period or treated with a medium, whereby a volume increase can be obtained. Different media can be utilized for this purpose, but the operational medium of the feeding aggregate 14 is excluded. Moreover, a combination of the thermal and chemical treatment for volume increase of the feeding member 26 can be provided.

When the feeding member 26 is subjected to a volume increase, it is thereafter positioned without a gap relative to the first wall part 30. Subsequently, the wall part 34 is mounted without a gap relative to the feeding member 26. In this position, in a next step, the wall part 30, 34 are fixed with one another. For this purpose a weld connection 43, an adhesive connection, and the like can be provided, depending on the available materials for the wall parts 30, 34. Thereby a circumferential welding 43, glueing or the like can be produced between the first and second wall parts 30, 34, and simultaneously a sealing of the pump chamber 29 is provided.

The wall part 30 preferably has a ring portion 35 which radially limits the pump chamber 29. Its inner diameter is insignificantly greater than the outer diameter of the second wall part 34. In joining condition, the ring portion 35 engages at least partially the wall portion 34, so that in a simple manner a sealing connection 43 can be provided between them. This arrangement has the advantage that the inner diameter of the ring portion 35 and the corresponding outer diameter of the wall part 34 can be made relatively inaccurate, and the measuring inaccuracies can be compensated by the advantageous design of the connection 43.

Figure 3:
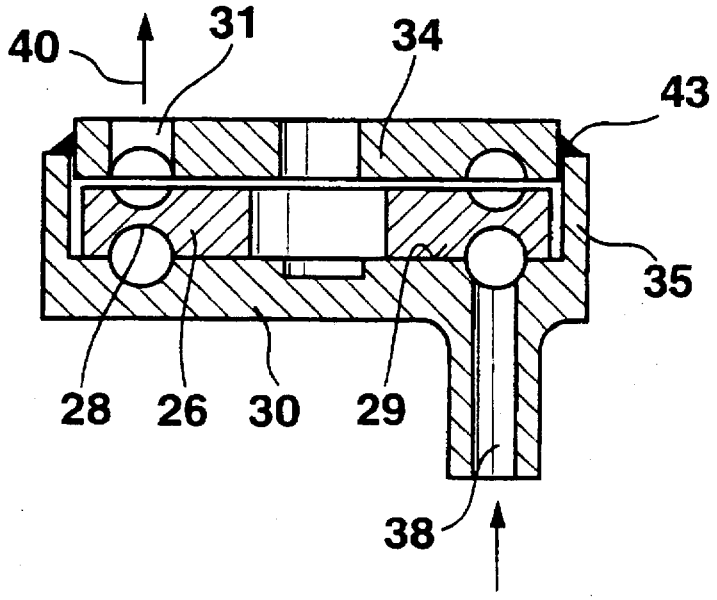
FIG. 3 is a view showing a feeding pump which is a part of the feeding aggregate, on an enlarged scale and partially sectioned in mounting condition.

When the feeding pump 24 after eliminating the volume increase is transferred into a mounting condition shown in FIG. 3, the feeding pump 24 is set in the housing 42. Subsequently, further required mounting steps can be performed for completion of the feeding aggregate 14. Because of the volume increase of the feeding member 26 caused by the treatment, a cost-intensive working of the adjoining surfaces of the feeding member 26 and the first and second wall part 30, 34 for producing the required axial gap can be dispensed with. The required axial gap is determined automatically and by the magnitude of the volume increase.

It will be understood that each of the elements described above, or two or more together, may also find a useful application in other types of constructions differing from the types described above.

While the invention has been illustrated and described as embodied in aggregate for feeding fuel from supply tank to internal combustion engine of motor vehicle, and method of producing the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An aggregate for feeding fuel from a supply tank to an internal combustion engine of a motor vehicle, comprising a feed pump having a disk-shaped feeding member; and means for forming a pump chamber in which said feeding member rotates, said means including a first wall part and a second wall part arranged at a distance from one another in direction of a rotary axis of said feeding member, at least one of said wall parts having a ring portion formed for a radial limiting and connectable with the other of said wall parts, said first and second wall parts and said feeding member which is preliminarily increased in volume are positioned relative to one another without a gap, and thereafter said first and second wall parts are fixedly connected with one another.

2. An aggregate as defined in claim 1, wherein said feeding member is preliminarily treated by a thermal treatment.

3. An aggregate as defined in claim 1, wherein said feeding member is preliminarily treated chemically by a medium which causes a swelling.

4. An aggregate as defined in claim 1, wherein said feeding member is chemically treated by a medium which causes a swelling but is different from an operating medium of said feeding pump.

5. An aggregate as defined in claim 1, wherein said feeding member is composed of synthetic plastic.

6. An aggregate as defined in claim 1; and further comprising means for forming a sealing connection between said one wall part and said ring portion so as to seal said pump chamber.

7. A method of producing an aggregate for feeding fuel from a supply tank to an internal combustion engine of a motor vehicle, the method comprising the steps of providing a disk-shaped feeding member of feed pump; forming a pump chamber in which the feeding member rotates, said forming including making said pump chamber of a first and a second wall part arranged at a distance from one another in direction of a rotary axis of the feeding member; radially limiting the pump chamber by a ring portion provided on one of the first and second wall parts; connecting the ring portion with the other of the wall parts; pretreating the feeding member so that it increases in volume; positioning the pretreated feeding member without a gap relative to the first and second wall parts; and then fixedly connecting the first and second wall parts with one another.

8. A method as defined in claim 7, wherein said pretreating step includes thermally treating the feeding member.

9. A method as defined in claim 7, wherein said preliminarily pretreating step includes chemically treating the feeding member so as to cause its swelling.

10. A method as defined in claim 9, wherein said chemically treating step includes treating the feeding member in a swelling medium which is different from an operating medium of the feed pump.

11. A method as defined in claim 7; and further comprising forming the feeding member of synthetic plastic.

12. A method as defined in claim 7; and further comprising providing between one of said wall parts and the ring portion, a connection which seals the pump.

* * * * *